US006955321B1

(12) United States Patent
Lewis

(10) Patent No.: US 6,955,321 B1
(45) Date of Patent: Oct. 18, 2005

(54) WALLPAPER INSTALLATION APPARATUS

(76) Inventor: Wilma J. Lewis, 2714 S. Hackley St., Muncie, IN (US) 47302

( * ) Notice: Subject to any disclaimer, the term of this patent is extended or adjusted under 35 U.S.C. 154(b) by 107 days.

(21) Appl. No.: 10/657,002

(22) Filed: Sep. 8, 2003

(51) Int. Cl.[7] ..... B65H 16/00
(52) U.S. Cl. ..... 242/588; 156/577; 156/579
(58) Field of Search ..... 242/597, 597.7, 242/597.8, 588, 588.1, 588.2, 405.3, 406, 242/597.5; 156/574, 575, 577, 579, 71, 308.6

(56) References Cited

U.S. PATENT DOCUMENTS

| | | | | |
|---|---|---|---|---|
| 1,797,854 A | * | 3/1931 | Carter | 156/523 |
| 3,861,988 A | * | 1/1975 | Preisler | 156/577 |
| 3,907,628 A | * | 9/1975 | Buske | 156/579 |
| 4,263,347 A | * | 4/1981 | Banta | 156/577 |
| 4,711,682 A | * | 12/1987 | Barbe et al. | 156/577 |
| 5,280,869 A | | 1/1994 | Ricci | |
| 5,328,543 A | * | 7/1994 | Campagna | 156/577 |
| 5,403,430 A | | 4/1995 | Araujo et al. | |
| 5,403,432 A | * | 4/1995 | Burch | 156/577 |
| 5,573,630 A | | 11/1996 | Edney et al. | |
| 5,743,485 A | | 4/1998 | Martorelli et al. | |
| 5,775,633 A | | 7/1998 | Zane | |
| 6,073,671 A | | 6/2000 | Chapman | |
| D428,315 S | | 7/2000 | Baker | |
| 6,464,164 B1 | * | 10/2002 | Cox et al. | 242/588.2 |

* cited by examiner

*Primary Examiner*—William A. Rivera

(57) ABSTRACT

A wallpaper installation apparatus is disclosed for assisting a user to affixed wallpaper to a wall and includes a substantially flat section having front and rear end portions. The flat section has a plurality of holes disposed between the front and rear end portions and are spaced apart from each other. The plurality of holes receive a plurality of corresponding fastening members therethrough for removably securing the apparatus to a wall. The apparatus further includes an arcuate section integral with the flat section and extending rearwardly therefrom. The arcuate section has an outer surface that extends outwardly away from a wall and forms an opening therebetween for receiving a roll of wallpaper therein. The arcuate section has a bottom surface integral with the outer surface for assisting to maintain a roll of wallpaper thereabove and for assisting same to unroll as a user slides the apparatus along a wall in a substantially horizontal and forward direction.

12 Claims, 3 Drawing Sheets

WALLPAPER INSTALLATION APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a wallpaper installation apparatus and, more particularly, to a wallpaper installation apparatus that holds the wallpaper in position while it is being applied, freeing the installers hands so that a single user can install the wallpaper.

2. Prior Art

The use of wallpaper has become popular in recent years. Wallpaper adds an inexpensive decorative accent to a room and can be applied by the home owner. A common problem is applying an entire roll continuously. One way to circumvent this application difficulty is to apply the wallpaper in sheet sections. However, this can lead to unsightly seams where the sections abut or overlap.

A single person has difficulty holding the wallpaper roll while trying to apply the adhesive. In order to secure the wallpaper in place, a method of holding the roll of wallpaper material in alignment to prevent pulling on the material already applied to the wall is helpful and expedites the application process. In addition, when a user is applying wallpaper at a height where a ladder must be used to reach the desired height, the user must step down off the ladder to move the ladder so that the user can apply wallpaper further down the wall. It is difficult for one person to maintain the roll of wallpaper in the proper position while moving the ladder. One alternative is to cut the border material into manageable lengths, but this often results in unsightly laps and joints.

A problem frequently faced by a professional wallpaper hanger is how to support a roll of wallpaper material, such as a roll of wallpaper border, particularly one that is to be applied to the wall surface adjacent to a high ceiling. The task is normally accomplished by an installer, with the use of a ladder or scaffold and assistance by a helper, who holds the roll of wallpaper material and unrolls the material as needed by the installer. It goes without saying that the job is both labor intensive and cumbersome for both the installer and the helper. If the wallpaper hanger decides to install the wallpaper himself, one hand must hold the wallpaper, while the other is doing all the application work (smoothing, gluing, washing, cutting).

Accordingly, a need remains for a wallpaper installation apparatus that can be fixed in position on a wall by a single user, enabling that user to move and position himself further along the wall without requiring the assistance of someone to hold the roll of wallpaper material in place.

BRIEF SUMMARY OF THE INVENTION

In view of the foregoing background, it is therefore an object of the present invention to provide an apparatus for single user wallpaper installation. These and other objects, features, and advantages of the invention are provided by an apparatus for wallpaper installation that holds the wallpaper in position while it is being applied, freeing the installer's hands so that a single user can install the wallpaper. The apparatus includes a substantially flat section having front and rear end portions. The rear portion has a height that is greater than the height of the front portion. The flat section has a plurality of holes disposed between the front and rear end portions that are spaced apart from each other. The plurality of holes are disposed generally medially of the front and rear portions. The plurality of holes receive a plurality of corresponding fastening members therethrough for removably securing the apparatus to a wall.

The apparatus further includes an arcuate section integral with the flat section and extending rearwardly therefrom. The arcuate section has an outer surface that extends outwardly away from a wall and forms an opening therebetween for receiving a roll of wallpaper therein. The arcuate section has a bottom surface integral with the outer surface for assisting to maintain a roll of wallpaper thereabove and for assisting same to unroll as a user slides the apparatus along a wall in a substantially horizontal and forward direction. The bottom surface is disposed substantially perpendicular to the outer surface. The flat and arcuate sections are preferably formed from plastic material.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
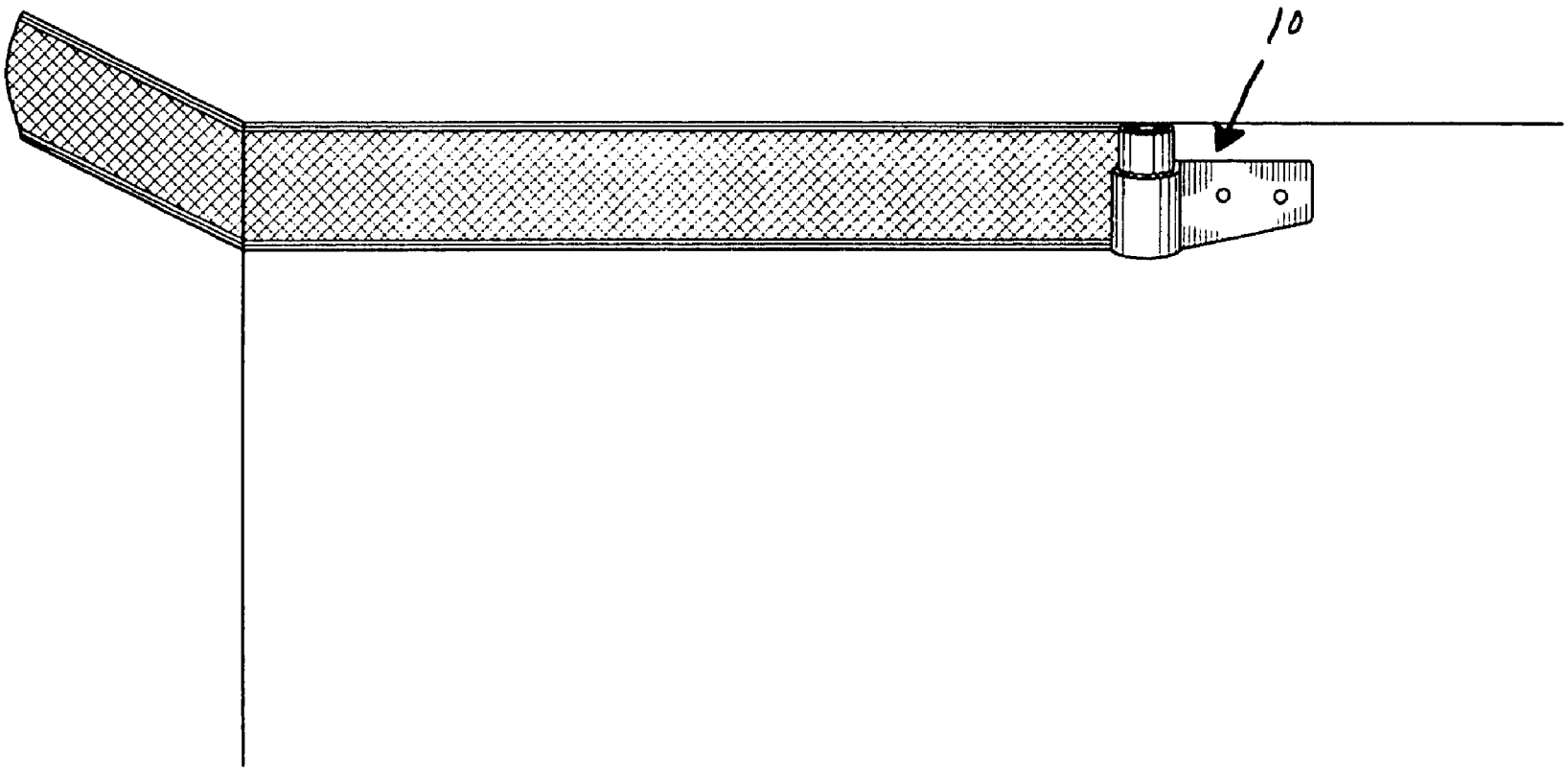
FIG. 1 is a perspective view showing an apparatus for installing wallpaper, in accordance with the present invention.
Figure 3:
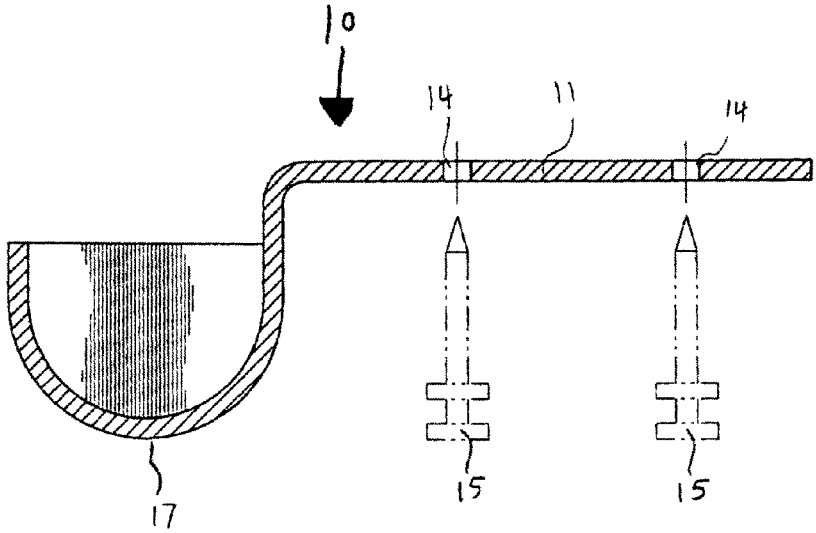
FIG. 3 is a top plan view taken along line 3—3 in FIG. 2.
Figure 2:
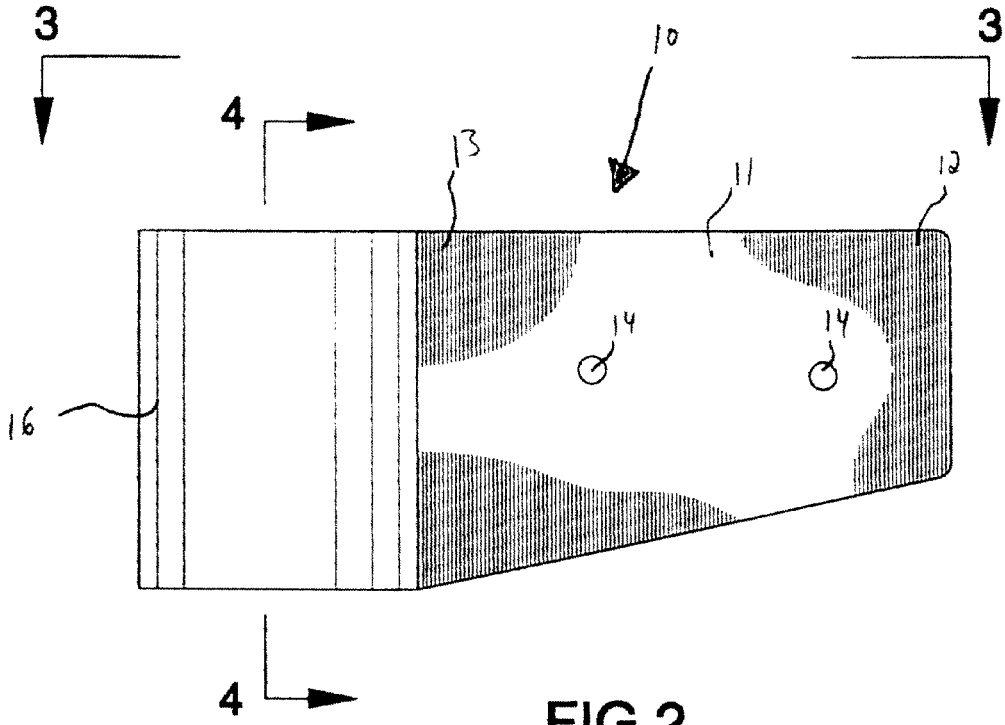
FIG. 2 is an enlarged front elevational view of the apparatus shown in FIG. 1.

The apparatus of this invention is referred to generally in FIG. 1 by the reference numeral 10 and is intended to be used to install wallpaper. It should be understood that the apparatus 10 may be used to install many different types of wallpapers and should not be limited to only installation of wallpaper borders. The apparatus 10 includes a substantially flat section 11 having front 12 and rear 13 end portions. The flat section 11 has a plurality of holes 14 receiving a plurality of corresponding fastening members 15, as shown in FIGS. 2–3. The plurality of holes 14 are disposed generally medially of the front 12 and rear 13 end portions of the substantially flat section 11.

Figure 4:
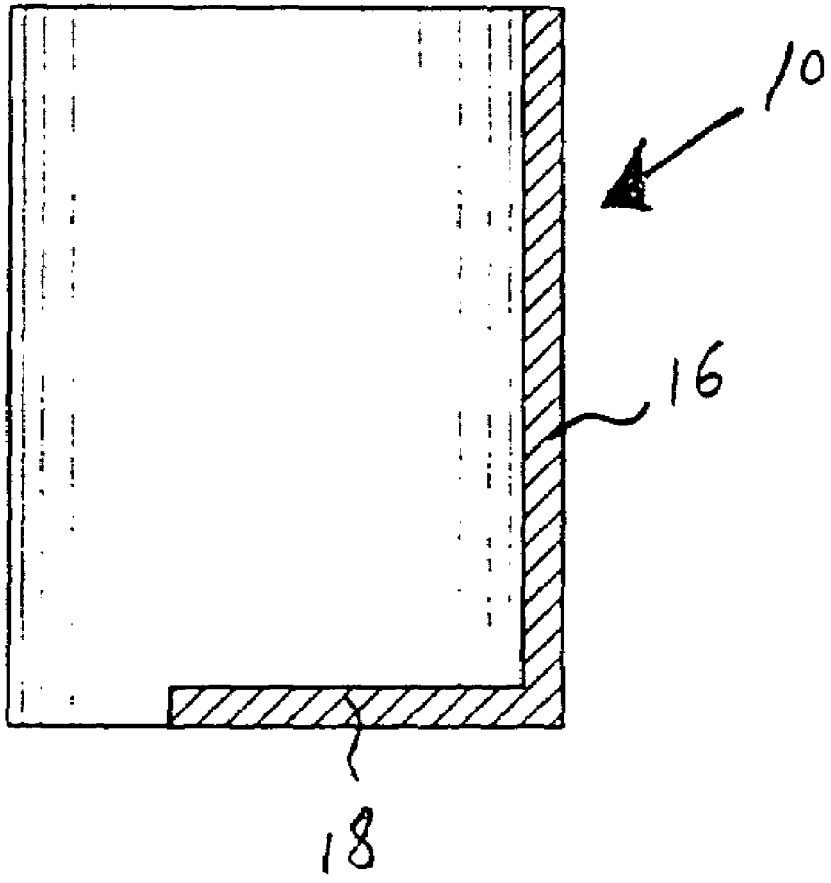
FIG. 4 is an enlarged cross sectional view of the apparatus shown in FIG. 1.

An arcuate section 16 for holding the wallpaper extends rearwardly from the rear end 13 of the flat section 11. The arcuate section 16 has an outer surface 17 that extends outward from a wall, forming an opening for receiving a roll of wallpaper. The arcuate section 16 has a bottom surface 18 extending inwardly from the outer surface 17 to assist a user in maintaining a roll of wallpaper inside the arcuate section 16 for application. The bottom surface 18 is substantially perpendicular to the outer surface 17 as shown in FIG. 4, preventing the wallpaper from sliding through the arcuate section 16. This enables the wallpaper to unroll as a user slides the apparatus 10 along a wall in a substantially horizontal and forward direction. When installing wallpaper using a ladder, the fastening members 15 can be used to secure the apparatus 10 to a wall, enabling the user to descend the ladder and move the ladder to a new position further along the wall. This enables a single user to apply wallpaper without any assistance. The apparatus 10 may be formed of plastic or metal.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A wallpaper installation apparatus comprising:

a substantially flat section having front and rear end portions, said flat section further having a plurality of holes disposed between the front and rear end portions and being spaced apart from each other, said plurality of holes receiving a plurality of corresponding fastening members therethrough for removably securing said apparatus to a wall; and an arcuate section integral with said flat section and extending rearwardly therefrom, said arcuate section having an outer surface extending outwardly away from a wall and forming an opening therebetween for receiving a roll of wallpaper therein, said arcuate section having a bottom surface integral with said outer surface for assisting to maintain a roll of wallpaper thereabove and for assisting same to unroll as a user slides said apparatus along a wall in a substantially horizontal and forward direction.

2. The apparatus of claim 1, wherein said bottom surface is disposed substantially perpendicularly to said outer surface.

3. The apparatus of claim 1, wherein said flat and arcuate sections are formed from plastic material.

4. The apparatus of claim 1, wherein said rear portion has a height that is greater than a height of said front portion.

5. The apparatus of claim 1, wherein said plurality of holes are disposed generally medially of said front and rear portions.

6. A wallpaper installation apparatus comprising:

a substantially flat section having front and rear end portions, said flat section further having a plurality of holes disposed between the front and rear end portions and being spaced apart from each other, said plurality of holes receiving a plurality of corresponding fastening members therethrough for removably securing said apparatus to a wall; and an arcuate section integral with said flat section and extending rearwardly therefrom, said arcuate section having an outer surface extending outwardly away from a wall and forming an opening therebetween for receiving a roll of wallpaper therein, said arcuate section having a bottom surface integral with said outer surface for assisting to maintain a roll of wallpaper thereabove and for assisting same to unroll as a user slides said apparatus along a wall in a substantially horizontal and forward direction, said bottom surface is disposed substantially perpendicularly to said outer surface.

7. The apparatus of claim 6, wherein said flat and arcuate sections are formed from plastic material.

8. The apparatus of claim 6, wherein said rear portion has a height that is greater than a height of said front portion.

9. The apparatus of claim 6, wherein said plurality of holes are disposed generally medially of said front and rear portions.

10. An apparatus for facilitating the installation of wallpaper, said apparatus comprising:

a substantially flat section having front and rear end portions, said flat section further having a plurality of holes disposed between the front and rear end portions and being spaced apart from each other, said plurality of holes receiving a plurality of corresponding fastening members therethrough for removably securing said apparatus to a wall, said plurality of holes being disposed generally medially of said front and rear portions; and an arcuate section integral with said flat section and extending rearwardly therefrom, said arcuate section having an outer surface extending outwardly away from a wall and forming an opening therebetween for receiving a roll of wallpaper therein, said arcuate section having a bottom surface integral with said outer surface for assisting to maintain a roll of wallpaper thereabove and for assisting same to unroll as a user slides said apparatus along a wall in a substantially horizontal and forward direction, said bottom surface is disposed substantially perpendicularly to said outer surface.

11. The apparatus of claim 10, wherein said flat and arcuate sections are formed from plastic material.

12. The apparatus of claim 10, wherein said rear portion has a height that is greater than a height of said front portion.

* * * * *